US007369086B2

(12) United States Patent
Luen

(10) Patent No.: US 7,369,086 B2
(45) Date of Patent: May 6, 2008

(54) MINIATURE VERTICALLY POLARIZED MULTIPLE FREQUENCY BAND ANTENNA AND METHOD OF PROVIDING AN ANTENNA FOR A WIRELESS DEVICE

(75) Inventor: Kong S. Luen, Germantown, MD (US)

(73) Assignee: FreeScale Semiconductor, Inc., Austin, TX (US)

( * ) Notice: Subject to any disclaimer, the term of this patent is extended or adjusted under 35 U.S.C. 154(b) by 601 days.

(21) Appl. No.: 10/403,492

(22) Filed: Mar. 31, 2003

(65) Prior Publication Data

US 2004/0192226 A1 Sep. 30, 2004

(51) Int. Cl.
*H01Q 1/38* (2006.01)

(52) U.S. Cl. ..... 343/700 MS

(58) Field of Classification Search ..... 343/700 MS, 343/702, 795, 820, 876
See application file for complete search history.

(56) References Cited

U.S. PATENT DOCUMENTS 4,827,271 A * 5/1989 Berneking et al. ... 343/700 MS
5,105,175 A * 4/1992 Kaltenecker ..... 333/219
5,507,012 A 4/1996 Luxon et al. ..... 455/89
5,532,708 A * 7/1996 Krenz et al. ..... 343/795
5,990,838 A * 11/1999 Burns et al. ..... 343/702
6,362,792 B1 * 3/2002 Sawamura et al. ..... 343/702
6,781,546 B2 * 8/2004 Wang et al. ..... 343/700 MS
6,933,893 B2 * 8/2005 Rubinshteyn et al. ..... 343/700 MS
2002/0057220 A1 * 5/2002 Sabet et al. ..... 343/700 MS
2002/0109642 A1 * 8/2002 Gee et al. ..... 343/876
2004/0113848 A1 * 6/2004 Gaucher et al. ..... 343/702

OTHER PUBLICATIONS

"Analysis of a Coaxially-fed Patch Antenna", published Jul. 9, 1998, and found at the web site http://lc.cray.com/apps/pat/.*

* cited by examiner

*Primary Examiner*—Huedung Mancuso
(74) *Attorney, Agent, or Firm*—Charles W. Bethards

(57) ABSTRACT

A miniature vertically polarized multi-frequency antenna 10 is embedded in a substrate 11 and suitable for use within a wireless device. The antenna 10 includes a first lateral member 14 and a second lateral member 16, which is spaced from and parallel to the first lateral member 14. The antenna 10 has a wide tuning range due to multiple resonances provided by the lateral members 14, 16. The antenna 10 is shortened by reactive loading and by embedding the antenna in material having a high dielectric constant. Tuning circuits 30, 32 are coupled to respective ends of one of the lateral members 14, 16. The tuning circuits are located on a common plane with the lateral member to which they are connected. The tuning circuits 30, 32 electronically add reactance to the antenna to alter the frequency at which it resonates. A method of providing the antenna 10 includes forming flat metal strips 14, 16 on layers of a laminated substrate 11 and forming the second lateral member 16 between adjacent layers 20, 22 of the substrate 11.

20 Claims, 2 Drawing Sheets

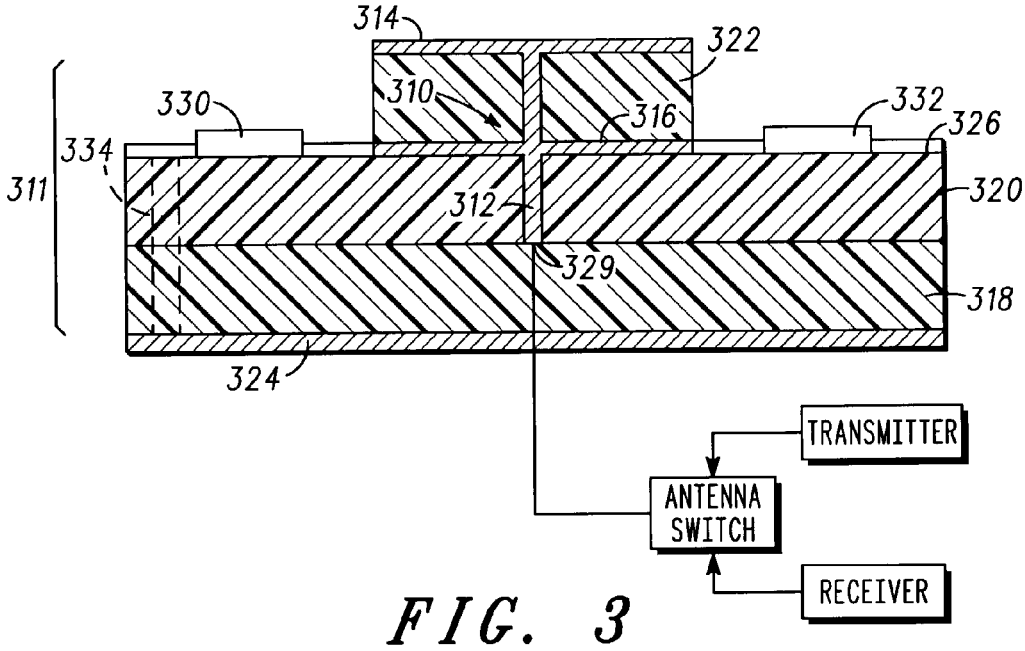
FIG. 3
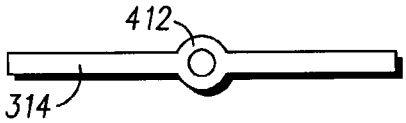
FIG. 4
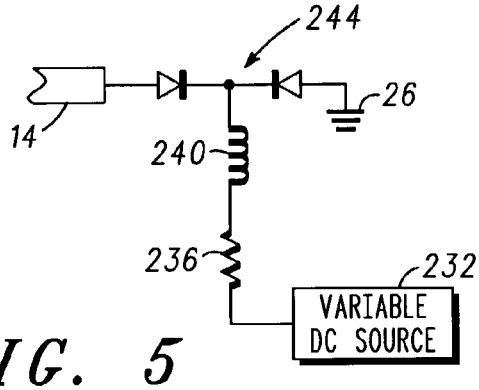
FIG. 5
| APPROXIMATE RESONANT FREQUENCY (GHz) | FIRST CAPACITANCE (pF) | SECOND CAPACITANCE (pF) |
|---|---|---|
| 4.2 | 0 | 0 |
| 3.5 | 1 | 0.5 |
| 2.5 | 1 | 2 |
| 1.8 | 2 | 4.2 |
| 1.6 | 2.6 | 5.2 |
FIG. 6

MINIATURE VERTICALLY POLARIZED MULTIPLE FREQUENCY BAND ANTENNA AND METHOD OF PROVIDING AN ANTENNA FOR A WIRELESS DEVICE

FIELD OF THE INVENTION

This invention relates in general to wireless communication devices, and more specifically to tunable, multiple-frequency, miniature monopole antennas for wireless communication devices.

BACKGROUND OF THE INVENTION

Wireless communication devices generally refer to communications terminals that provide a wireless communications link to one or more other communications terminals or equipment. Wireless communication devices may be used in a variety of different applications, including cellular telephone, land-mobile (e.g., police and fire departments), satellite communications systems, wireless Local Area Networks, and the like. Wireless communication devices typically include an antenna for transmitting and/or receiving wireless communications signals. In the current wireless communication environment, wireless communication devices require the ability to use broad or multiple frequency bands. Such devices may need to work in geographical areas with different local communications frequencies. In addition, the recent trend is to further miniaturize such devices and to make the antenna invisible. However, it is difficult to satisfy these requirements while maintaining high efficiency and a desired radiation pattern, and the manufacture of such antennas is relatively complicated and expensive.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 3 is a diagrammatic cross sectional view like FIG. 2 of a second embodiment of the invention;

FIG. 4 is a diagrammatic top view of the antenna showing a further embodiment of the invention;

FIG. 5 is a schematic diagram of a tuning circuit coupled to the antenna of FIG. 1;

FIG. 6 is a table showing various resonant frequencies of the antenna of the present invention in relation to various capacitances of the tuning circuit.

DETAILED DESCRIPTION OF PREFERRED EMBODIMENTS

Figure 1:
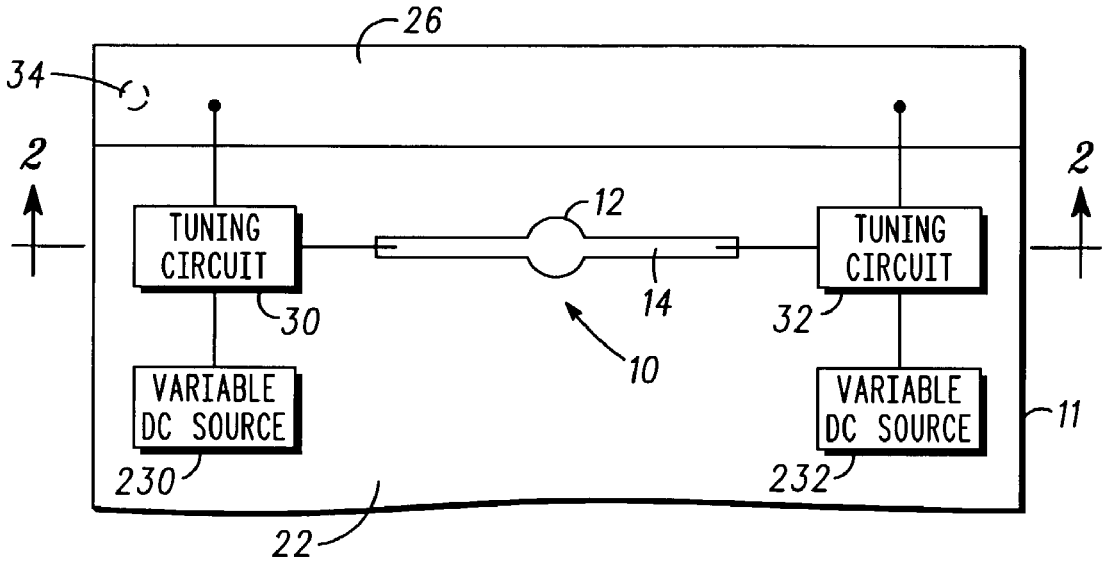
FIG. 1 is a diagrammatic top view of a substrate that includes an antenna.

In overview, the present disclosure concerns communications devices and systems that provide services such as voice and data communications services to communications devices or units, often referred to as subscriber devices, such as cellular phones and two-way radios and the like and more specifically to concepts and principles for providing small antennas for such devices.

The communications systems and communications devices that are of particular interest are those that provide or facilitate voice communications services or data or messaging services, such as conventional two way systems and devices, various cellular phone systems including analog and digital cellular, CDMA (code division multiple access) and variants thereof, GSM, GPRS (General Packet Radio System), 2.5 G and 3G systems such as UMTS (Universal Mobile Telecommunication Service) systems, integrated digital enhanced networks and variants or evolutions thereof. Similarly, the communication systems and devices can include LAN (local area network) systems that employ anyone of a number of networking protocols, such as TCP/IP (Transmission Control Protocol/Internet Protocol), AppleTalk™, IPX/SPX (Inter-Packet Exchange/Sequential Packet Exchange), Net BIOS (Network Basic Input Output System) or any other packet structures.

As further discussed below various inventive principles and combinations thereof are advantageously employed to provide an antenna that is small and inexpensive for a wireless communication device, thus alleviating various problems associated with known antennas and wireless devices provided these principles or equivalents thereof are utilized.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, upper and lower and the like are used solely to distinguish one from another entity or action without necessarily requiring or implying any actual such relationship or order between such entities or actions.

Much of the inventive functionality and many of the inventive principles are best implemented with or in various substrate technologies. It is expected that one of ordinary skill, notwithstanding possibly significant effort and many design choices motivated by, for example, available time, current technology, and economic considerations, when guided by the concepts and principles disclosed herein will be readily capable of generating such substrates with minimal experimentation. Therefore, in the interest of brevity and minimization of any risk of obscuring the principles and concepts according to the present invention, further discussion of such substrate technologies, if any, will be limited to the essentials with respect to the principles and concepts used by the preferred embodiments.

Figure 2:
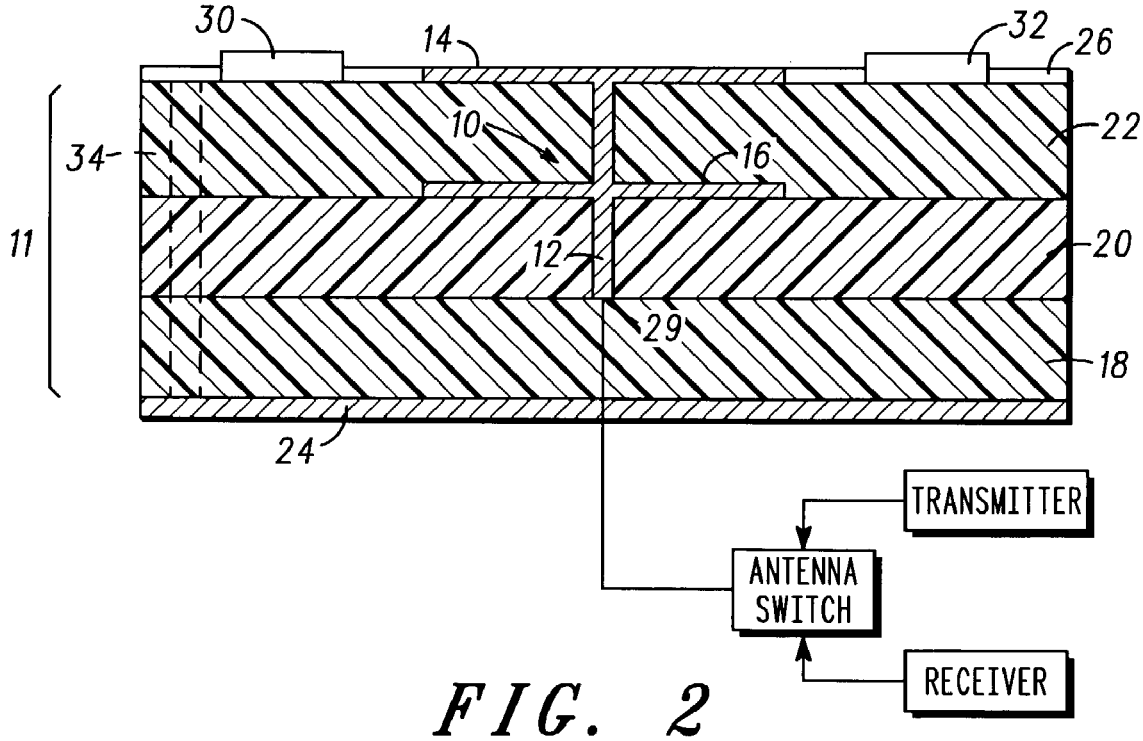
FIG. 2 is a diagrammatic cross sectional view taken along the plane indicated by the line 2-2 in FIG. 1.

FIGS. 1 and 2 illustrate an antenna 10 and a wireless communication device that includes the antenna 10. The antenna 10 includes a substantially straight main member 12, and the main member 12 is metal and is embedded in a substrate 11. The antenna 10 also includes a first lateral member 14, a central part of which is electrically coupled to an upper end of the main member 12 such that the main member 12 and the first lateral member 14 generally form a T shape. A second lateral member 16, a central part of which is electrically coupled to the main member 12, is spaced from and parallel to the first lateral member 14. The second lateral member 16 is embedded in the substrate 11.

FIG. 2 shows a first embodiment of a wireless communication device including a receiver and a transmitter and the antenna 10. The antenna 10 is a vertical radiator that can resonate at multiple frequencies. Thus, a wireless device that employs the antenna 10 has multiple-frequency tuning capability. The frequency at which the antenna 10 operates is determined by factors such as the length of the elements 12, 14, 16, capacitive loading and the material surrounding the antenna 10; however, experimentally the antenna 10 was made to operate at frequencies from about 1.5 to about 3.5 GHz. Incidentally, the figures are not to scale and are merely diagrammatic.

The antenna 10 has vertical polarization and an omnidirectional radiation pattern. Vertical polarization is preferred to minimize the multipath problem present in many wireless devices.

Referring to FIG. 2, the antenna 10 is generally a vertical, one quarter wave monopole type antenna. The exact length of the antenna 10 depends on many factors, such as the material of the substrate 11 and the reactive loading of the antenna 10 and the desired resonant frequency. One purpose of the present invention is to provide a miniature antenna. Thus, the antenna 10 has been shortened, with respect to a length of one-fourth of the wavelength at the desired frequency, by both reactive loading and by embedding the antenna 10 in material having a relatively high dielectric constant, as discussed below. In an experimental prototype designed to operate at about 2.4 GHz, the length of the antenna 10 was approximately 0.4 inches. Thus, the antenna 10 is approximately one third of the length of a quarter wavelength antenna operating at 2.4 GHz.

The length of the antenna 10 is affected by the dielectric constant of the material that surrounds it. Embedding the antenna 10 in the substrate 11 reduces the length of the antenna 10 by a factor of 1/sqrt(Er), where Er is the dielectric constant of the material in which the antenna 10 is embedded. In other words, in comparison to an antenna surrounded by air, the length of an antenna is shortened by a factor of the reciprocal of the square root of the dielectric constant of the material surrounding the antenna.

As shown in FIG. 2, the main member 12 is embedded in the substrate 11 and is perpendicular to the plane of the substrate 11. The main member 12 is metal and may be a solid wire or a plated through hole, or via hole 34. FIG. 2 shows the main member 12 as a solid wire, and FIG. 4 shows an alternative embodiment in which a main member 412 is formed by a plated through hole. Thus, the main member 12, 412 is formed with a conventional circuit board component and is relatively simple to make.

The substrate 11 is preferably a multi-layered circuit board, as shown in the figures. The substrate 11 of the embodiment of FIG. 2 includes a bottom layer 18, a middle layer 20, and an upper layer 22. The material of the substrate 11 can be any of several conventional circuit board materials such as glass epoxy, however, materials with relatively high dielectric constants are preferred. For example, the layers of the substrate 11 may be made of FR4, which is a common circuit board material of glass epoxy. In the case of FR4, the dielectric constant is approximately 4.5. The reciprocal of the square root of 4.5 is 0.47. Thus, when embedded in FR4, the antenna 10 can be shortened by a factor of 0.47, in comparison to a one-quarter wavelength antenna that operates at the same frequency. The antenna 10 can be embedded in other materials with higher dielectric constants to further reduce the length of the antenna 10.

The length of the antenna 10 can also be reduced by reactive loading. In other words, adding reactance, in this case, capacitance, to an antenna effectively lengthens the antenna. Even without tuning circuits coupled to the antenna 10, the first and second lateral members 14, 16 add capacitance to the antenna 10 and thus permit a reduction in the length of the antenna 10. As discussed later, in the preferred embodiment, tuning circuits are coupled to the antenna 10, which add capacitance and permit further shortening of the antenna 10.

The first lateral member 14 is a thin, flat metal strip, which is located on the upper surface of the upper layer 22 of the substrate 11. The first lateral member 14 is parallel to a lower ground plane 24. The first lateral member 14 may be etched from a layer of metal initially covering the surface of the substrate 11. Alternatively, the first lateral member 14 may be formed by any conventional means for placing metal traces on printed circuit boards.

The second lateral member 16 is also a thin, flat metal strip, which is located between adjacent layers of the substrate 11. In the illustrated embodiment, the second lateral member 16 is located between the middle layer 20 and the upper layer 22 of the substrate 11; however, the number of layers is arbitrary and depends on the particular requirements of the device. The second lateral member 16 is parallel to and spaced from the first lateral member 14 in a direction perpendicular to the plane of the substrate 11. As shown in the drawings, it is preferred that the second lateral member 16 be located approximately midway along the length of the main member. The second lateral member 16 is formed by any conventional method of forming a metal trace on a circuit board. The second lateral member 16 is formed on a surface of a middle layer 20 of the substrate 11 before the substrate 11 is laminated. After the second lateral member 16 is formed, the substrate 11 is laminated, which places the second lateral member 16 between adjacent layers and thus embeds the second lateral member 16 in the substrate 11.

The lengths of the first lateral member 14 and the second lateral member 16 are set according to the desired resonance. However, if a tuning circuit is used, as discussed below, the length is not particularly important, since the tuning circuit can be used to adjust the resonant frequency of the antenna 10. The lengths of the lateral members 14, 16 need not be the same.

The traces forming the first and second lateral members 14, 16 serve to retain radiation efficiency. That is, shortening an antenna generally reduces the efficiency of the antenna. However, the lateral members 14, 16 improve the efficiency and somewhat offset the losses of shortening the antenna 10. The efficiency of an experimental prototype was greater than 50%.

The provision of two lateral strips improves the tuning range of the antenna 10 as compared with a similar antenna having only one lateral strip. That is, it is believed that each of the lateral members 14, 16 acts as a capacitor and provides a separate resonant frequency at which the antenna 10 operates. Thus, the antenna 10 is a multi-frequency antenna and can operate in two narrow frequency bands or a single wide frequency band.

As shown in FIG. 2, the lower end of the main member forms an antenna port 29, by which the antenna 10 is coupled to a transmitter or a receiver. A metal strip (not shown) may be used to couple the lower end of the main member 12 to, for example, an antenna switch. The main member 12 preferably terminates at the interface between two adjacent layers of the substrate 11. A metal strip located between the two adjacent layers can be coupled to the lower end of the main member 12 to facilitate coupling of the antenna 10 to an antenna switch.

The substrate 11 of the preferred and illustrated embodiment includes an upper ground plane 26 and the lower ground plane 24, and the main member 12 is perpendicular to the ground planes. The ground planes are metal layers, such as copper layers, which are laminated with the layers of the substrate 11. The upper ground plane 26 may be formed by the same metal layer that forms the upper lateral member, in which case the first lateral member 14 and the upper ground plane 26 have the same thickness, as illustrated in FIG. 2. The metal in areas where no metal should exist may be removed by etching, for example, for forming various parts of the communication device. Although not depicted in FIG. 1, it is preferred that the upper ground plane 26 be spaced from the first lateral member 14 as far as possible to avoid interference by the upper ground plane 26 with the radiation pattern of the antenna 10. For the same reason, the upper ground plane 26 should be as small as possible. The upper ground plane 26 is electrically coupled to the lower ground plane 24 through at least one via hole 34.

Although the antenna 10 may be used without a tuning circuit, it is preferred that at least one tuning circuit is coupled to the antenna 10 for electronically varying the resonance of the antenna 10. In the preferred embodiment, one tuning circuit is coupled to each end of one of the lateral members; however, alternatively, one tuning circuit may be connected to only one end of one of the lateral members. FIG. 1 shows the tuning circuit in the form of a box, and FIG. 5 shows a schematic view of an exemplary tuning circuit.

In the embodiment of FIGS. 1 and 2, a first tuning circuit is coupled to a first end of the first, or upper, lateral member 14, and the device includes a second tuning circuit coupled to a second end of the upper lateral member 14. As shown in FIG. 1, a first variable DC voltage source 230 is coupled to the first tuning circuit 30, and a second variable DC voltage source 232 is coupled to the second tuning circuit 32.

The variable voltage sources 230, 232 control the resonance of the antenna 10 as discussed below.

The first lateral member 14 and the tuning circuits 30, 32 are located on the upper layer 22 of the substrate 11. That is, the lateral member to which the tuning circuits 30, 32 are coupled and the tuning circuits 30, 32 are located on the same layer of the substrate 11. This facilitates the manufacture of the wireless communication device. That is, having the tuning circuits and the upper lateral member on the same plane makes it easier to connect them electronically with conventional manufacturing techniques. Preferably, also, the variable voltage sources 230, 232 are located on the same substrate layer as the associated tuning circuits 30, 32.

The purpose of the tuning circuits is to electronically alter the frequencies at which the antenna 10 resonates. This can be accomplished in many ways, one of which is to couple a reactance to the antenna 10. The reactance is preferably a capacitive reactance, but may be a combination of a capacitive reactance and inductive reactance. The resonance of the antenna 10 depends on the reactance applied to the antenna 10.

FIG. 5 shows a detailed schematic of a tuning circuit that can be used for tuning the antenna 10. FIG. 5 shows only the second tuning circuit, however, the first tuning circuit is preferably a mirror image of the second tuning circuit.

The tuning circuit of FIG. 5 includes a varactor diode 244, which is employed to add the capacitive reactance to the antenna 10. A varactor diode behaves like a variable capacitor. The capacitance of the varactor diode 244 is dependent on a voltage applied to the varactor diode 244. In FIG. 5, one end of the varactor diode 244 is coupled to a second end of the first lateral member 14. The other end of the varactor diode 244 is connected to ground, which in this case is the upper ground plane 26.

As shown in FIG. 5, a variable DC voltage source 232 is coupled to the varactor diode 244, to vary the capacitance added to the antenna 10. By varying the voltage applied to the varactor diode 244, the capacitance of the diode 244 can be varied. Variation of the voltages of the variable DC voltage sources 230, 232 thus changes the resonant frequency of the antenna 10. The table of FIG. 5 shows various first capacitances and second capacitances in relation to approximate resonant frequencies that were determined for an experimental prototype of the antenna 10. In the table of FIG. 6, the first capacitance is the capacitance of the first varactor diode, not shown, of the first tuning circuit 30, and the second capacitance is the capacitance of the second varactor diode 244 of the second tuning circuit 32. FIG. 6 illustrates the multi-frequency nature of the antenna 10. Though not illustrated, a processor may be connected to the variable DC voltage sources 230, 232 to control their output voltages.

In FIG. 5, the variable DC voltage source 232 is connected to the varactor diode through a resistor 236 and an inductor 240. The resistor 236 is simply for limiting current. The inductor 240 serves to block high frequency signals, such as those radiated by the antenna, from reaching the voltage source 232 and thus resulting in unexpected and undesired loading for the antenna.

The effect of surrounding the antenna 10 with material of a predetermined dielectric constant and the capacitive loading is to reduce the length of the antenna 10 to approximately one-third of the length it would have as a quarter wavelength monopole antenna operating at the same frequency. Thus, for example, the height of a conventional monopole antenna operating in the range of 2.4 GHz is 1.229 inches, and the height of a prototype antenna shortened according to the present invention operating in the same frequency range was 0.400 inches. Therefore, the antenna 10 is well suited for miniature wireless communication devices.

FIG. 3 shows a second embodiment of the invention. The wireless device of the second embodiment includes an antenna 310. The antenna 310 includes a main member 312, a first lateral member 314, a second lateral member 316, and a port 329. The main member 312 is embedded in a substrate 311 as shown. Again, the main member 312 may be a solid wire, as shown in FIG. 3, or a hollow via hole, as shown in FIG. 4. The substrate 311 includes a lower ground plane 324, a bottom layer 318, a middle layer 320, an upper layer 322, and an upper ground plane 326. The lower ground plane 324 is coupled to the upper ground plane 326 by a via hole 334. A first tuning circuit 330 and a second tuning circuit 332 are located on the same plane as the second lateral member 316 and are connected to the second lateral member 316.

The wireless communication device of the second embodiment is like that of the first embodiment, except that the tuning circuits 330, 332 are coupled to the second lateral member 316 instead of the first lateral member 314 and are located on the middle layer 320. The upper layer 322 of the substrate 311 is smaller than the corresponding layer 22 of the first embodiment to make room on the middle layer 320 for accommodating the tuning circuits 330, 332 and the upper ground plane 326. In other words, in the second embodiment, the first lateral member 314 is located on a first layer of the substrate 311, and the tuning circuits 330, 332 and the second lateral member 316 are located on a second layer 320 of the substrate 311. The second lateral member 316 is coplanar with the upper ground plane 326 in the second embodiment. The antenna 310 of the second embodiment may be used to reduce the overall height of the substrate, since components can be located on the middle layer 320 rather than the upper layer.

In a further embodiment (not illustrated), the substrate 11 may be a silicon substrate, and the antenna 10 can be manufactured and embedded using conventional semiconductor manufacturing techniques. In this case, further, the components of the tuning circuits 30, 32 can also be manufactured on the same substrate using conventional semiconductor manufacturing techniques.

The arrangement of the antenna parts facilitates manufacture, as mentioned above. The manufacturing process of the antenna 10 includes forming a first metal strip 14 on a first substrate layer 22; and forming a second metal strip 16 on a second substrate layer 20. The method includes stacking, or laminating, the first substrate layer 22 on the first substrate layer 20 to form a layered substrate 11 such that the first metal strip 16 is parallel to and spaced apart from the second metal strip 14. The first metal strip 14 may be formed before or after the layers are stacked, or laminated. The first metal strip 16 is coupled to the second metal strip 14 with a main antenna member 12, which is perpendicular to the first metal strip 14 and the second metal strip 16. The method may include forming the main antenna member 12 by forming a hole in the layered substrate 11 and by placing metal material in the hole. The main antenna member 12 may be formed after the layers 20, 22 of the substrate 11 are laminated. Alternatively, the main antenna member 12 may be formed in sections in the individual layers 20, 22 prior to lamination. Further, the method may include placing a tuning circuit for tuning the antenna 10 on the same substrate layer as the second metal strip 16. Alternatively, the method may include placing a tuning circuit on the same substrate layer as the first metal strip 14.

The apparatus and methods discussed above and the inventive principles thereof are intended to and will alleviate problems caused by prior antennas and wireless communication devices. Using these principles of miniaturization and manufacturing will facilitate the availability of efficient, lower cost devices thus contributing to user satisfaction. It is expected that one of ordinary skill given the above described principles, concepts and examples will be able to implement other alternative procedures and constructions that offer the same benefits. It is anticipated that the claims below cover many such other examples.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An antenna comprising:

a substantially straight main member, wherein the main member is metal and is embedded in a substrate, the main member generally perpendicular to a plane of the substrate and passing through a portion of the substrate;

a first lateral member, a central part of which is electrically coupled to an upper end of the main member such that the main member and the first lateral member generally form a T shape, the first lateral member having a generally rectangular shape when viewed from above the T shape;

a second lateral member, a central part of which is electrically coupled to the main member, wherein the second lateral member is spaced from and parallel to the first lateral member, and the second lateral member is embedded in the substrate; and a turning circuit coupled to the antenna for varying resonance of the antenna, wherein the first lateral member and the turning circuit are located on a same layer of the substrate.

2. The antenna of claim 1, wherein the first lateral member is a thin, flat metal strip, which is located on an upper surface of the substrate.

3. The antenna of claim 1, wherein the substrate is a multi-layer substrate, and the second lateral member is a thin, flat metal ship located between adjacent layers of the substrate.

4. The antenna of claim 1 wherein the tuning circuit further includes a first tuning circuit coupled to a first end of the first lateral member and a second tuning circuit coupled to a second end of the first lateral member.

5. The antenna of claim 1, wherein the tuning circuit includes a varactor diode, which adds capacitance to the antenna.

6. The antenna of claim 5, wherein a variable voltage source is coupled to the varactor diode to vary capacitance added to the antenna.

7. The antenna of claim 5, wherein the tuning circuit includes a variable voltage source, which is coupled to the varactor diode for varying a voltage applied to the varactor diode.

8. The antenna of claim 1, wherein a variable DC voltage source is coupled to the tuning circuit, wherein a variation of the voltage of the variable DC voltage source changes a resonant frequency of the antenna.

9. The antenna of claim 1, wherein the substrate includes a ground plane, and the main member is perpendicular to the ground plane.

10. The antenna of claim 1, wherein a lower end of the main member forms an antenna port, by which the antenna is coupled to a transmitter or a receiver.

11. An antenna comprising:

a substantially straight main member, wherein the main member is metal and is embedded in a substrate, the main member generally perpendicular to a plane of the substrate and passing through a portion of the substrate;

a first lateral member, a central part of which is electrically coupled to an upper end of the main member such that the main member and the first lateral member generally form a T shape, the first lateral member having a generally rectangular shape when viewed from above the T shape;

a second lateral member, a central part of which is electrically coupled to the main member, wherein the second lateral member is spaced from and parallel to the first lateral member, and the second lateral member is embedded in the substrate; and a tuning circuit comprising a first tuning circuit coupled to a first end of the second lateral member and a second tuning circuit coupled to a second end of the second lateral member.

12. The antenna of claim 11, wherein the first lateral member is located on a first layer of the substrate, and the tuning circuit and the second lateral member are located on a second layer of the substrate.

13. The antenna of claim 11, wherein the substrate is a multi-layer substrate, and the second lateral member is a thin, flat metal strip located between adjacent layers of the substrate.

14. The antenna of claim 11, wherein the tuning circuit includes a varactor diode, which adds capacitance to the antenna.

15. The antenna of claim 11, wherein a variable DC voltage source is coupled to the tuning circuit, wherein a variation of the voltage of the variable DC voltage source changes a resonant frequency of the antenna.

16. An antenna comprising:

a substantially straight main member, wherein the main member is metal and is embedded in a substrate, the main member generally perpendicular to a plane of the substrate and passing through a portion of the substrate;

a first lateral member, a central part of which is electrically coupled to an upper end of the main member such that the main member and the first lateral member generally form a T shape, the first lateral member having a generally rectangular shape when viewed from above the T shape; and a second lateral member, a central part of which is electrically coupled to the main member, wherein the second lateral member is spaced from and parallel to the first lateral member, and the second lateral member is embedded in the substrate, wherein the substrate includes an upper ground plane and a lower ground plane, and the first lateral member is coplanar with the upper ground plane.

17. The antenna of claim 16, wherein the second lateral member is coplanar with the upper ground plane.

18. The antenna of claim 16 further including a tuning circuit coupled to the antenna for varying resonance of the antenna.

19. The antenna of claim 18 wherein the tuning circuit farther includes a first tuning circuit coupled to a first end of the first lateral member and a second tuning circuit coupled to a second end of the first lateral member.

20. The antenna of claim 18, wherein the tuning circuit includes a varactor diode, which adds capacitance to the antenna.

* * * * *

UNITED STATES PATENT AND TRADEMARK OFFICE

CERTIFICATE OF CORRECTION

PATENT NO. : 7,369,086 B2
APPLICATION NO. : 10/403492
DATED : May 6, 2008
INVENTOR(S) : Kong S. Luen It is certified that error appears in the above-identified patent and that said Letters Patent is hereby corrected as shown below:

Column 8 line 19 please delete “turning” and insert --tuning--
Column 8 line 21 please delete “turning” and insert --tuning--
Column 8 line 28 please delete “ship” and insert --strip--

Signed and Sealed this

Nineteenth Day of August, 2008

JON W. DUDAS
*Director of the United States Patent and Trademark Office*